US005559580A

United States Patent [19]

Niizawa et al.

[11] Patent Number: 5,559,580

[45] Date of Patent: Sep. 24, 1996

[54] IMAGE FORMING APPARATUS HAVING A BIPOLAR PHOTOSENSITIVE MEMBER

[75] Inventors: Koji Niizawa, Toyokawa; Masami Matsuura, Toyohashi; Hideo Yamaki, Toyokawa, all of Japan

[73] Assignee: Minolta Co., Ltd., Osaka, Japan

[21] Appl. No.: 457,142

[22] Filed: Jun. 1, 1995

[30] Foreign Application Priority Data

Jun. 8, 1994 [JP] Japan ..... 6-126367
Apr. 10, 1995 [JP] Japan ..... 7-084034

[51] Int. Cl.[6] ..... G03G 15/045; G03G 15/00

[52] U.S. Cl. ..... 355/219; 355/271; 355/226

[58] Field of Search ..... 355/271, 219, 355/226, 44, 45, 210

[56] References Cited

U.S. PATENT DOCUMENTS 3,877,803 4/1975 Seliger .
4,678,134 7/1987 Ameur .
4,711,559 12/1987 Sambayashi .
4,739,368 4/1988 Lachut et al. .
4,811,045 3/1989 Matsushita et al. .
4,821,067 4/1989 Oushiden et al. .
4,873,552 10/1989 Otsuki ..... 355/271
4,998,138 3/1991 Sambayashi et al. ..... 355/271 X

FOREIGN PATENT DOCUMENTS 57-78554 4/1982 Japan .
59-113449 6/1984 Japan .
60-107052 6/1985 Japan .
62-15863 4/1987 Japan .
1-307769 12/1989 Japan .

*Primary Examiner*—R. L. Moses
*Attorney, Agent, or Firm*—Burns, Doane, Swecker & Mathis, L.L.P.

[57] ABSTRACT

In a microfilm reader printer, a photosensitive member which can be charged to be positive and negative. The photosensitive member is charged to be positive in a reverse development mode and charged to be negative in a normal development mode. In the reverse development mode at least right before the reverse development mode is switched to the normal development mode, not only a charge area but also a non-charge area are irradiated by a main eraser. On the other hand, in the normal development mode at least right before the normal development mode is switched to the reverse development mode, only a charge area is irradiated by the main eraser.

2 Claims, 9 Drawing Sheets

CHARGE CHARACTERISTIC RIGHT AFTER NORMAL DEVELOPMENT MODE IS SWITCHED TO REVERSE DEVELOPMENT MODE

CHARGE CHARACTERISTIC OF BIPOLAR PHOTOSENSITIVE MEMBER

CHARGE CHARACTERISTIC RIGHT AFTER REVERSE DEVELOPMENT MODE IS SWITCHED TO NORMAL DEVELOPMENT MODE

IMAGE FORMING APPARATUS HAVING A BIPOLAR PHOTOSENSITIVE MEMBER

BACKGROUND OF THE INVENTION

1. Field of the invention

The present invention relates to an image forming apparatus, and more particularly to an image forming apparatus for forming an image on a sheet in an electrophotographic method which has steps of charge, exposure, development and transfer.

2. Description of Related Art

An electrophotographic method has, in a relationship between an original image and a reproduced image, a normal development mode wherein a positive image is obtained from a positive original and a reverse development mode wherein a positive image is obtained from a negative original. In a reader printer which exposes a microfilm to a light and projects its image on a screen or reproduces an image on a sheet in an electrophotographic method, since the microfilm can be positive and negative, the reader printer should be able to carry out the normal developing mode and the reverse developing mode selectively.

Thus, on the premise that one kind of toner which is charged with a specified polarity is used in a development process, a reader printer which has a bipolar photosensitive member is provided. The bipolar photosensitive member can be charged to have either a positive polarity or a negative polarity. For example, when the microfilm is positive, the bipolar photosensitive member is charged to have the negative polarity to form a positive latent image. A toner which is charged to a positive polarity is deposited on an image portion which has a high electric potential. On the other hand, when the microfilm is negative, the bipolar photosensitive member is charged to have positive polarity to form a negative latent image. In this case, the toner which is charged to have the positive polarity is deposited on the formed latent image which has a low electric potential.

However, right after the charge polarity is switched, the conventional bipolar photosensitive member can not be charged with a specified voltage by a charger set at a specified output value. Therefore, inconveniences such as lowering of the toner depositing amount (lowering of the image density) in the normal development mode and toner deposition on the background in the reverse development mode occur. Thus, right after the image forming mode is switched, the bipolar photosensitive member is rotated by a specified amount to be charged for elimination of the influence of the previous charging (this is called "pre-charging" following description). However, for purposes of rapidity, it is preferable that the pre-charging process is eliminated or finished in a short time.

SUMMARY OF THE INVENTION

An object of the present invention is to provide an image forming apparatus which can, when the charge polarity of the bipolar photosensitive member is switched to form an image, finish the pre-charging process in a short time.

Another object of the present invention is to provide an image forming apparatus which can, when the charge polarity of the bipolar photosensitive member is switched to form an image, eliminate the pre-charging process.

In order to attain the objects, an image forming apparatus according to the present invention comprises a bipolar photosensitive member, a main charger, an exposure optical system, a developing device, a transfer charger, an eraser using light, and a controller for controlling the eraser. The controller has a first control mode wherein not only a charge area but also a non-charge area are irradiated by the eraser in an image forming operation, wherein the bipolar photosensitive member is charged to a first polarity at least right before the operation is switched to an image forming operation wherein the bipolar photosensitive member is charged to a second polarity. The controller also has a second control mode wherein only a charge area on the bipolar photosensitive member is irradiated by the eraser in an image forming operation wherein the bipolar photosensitive member is charged to the second polarity at least right before the operation is switched to an image forming operation wherein the bipolar photosensitive member is charged to the first polarity.

In the above structure, when a mode wherein the image forming operation is carried out with the photosensitive member charged to the first polarity is switched to a mode wherein the image forming operation is carried out with the photosensitive member charged to the second polarity, or when the mode is switched the opposite way, at least in the image forming operation right before the mode switching, the area on the bipolar photosensitive member which is irradiated by the eraser is different in order to prevent the deterioration of the charging characteristic in next copying operation which is carried out in different polarity. As a result, the required number of the pre-charging process is decreased from two to one. Thereby, the image forming operation can be started in a short time.

Further, an image forming apparatus according to the present invention comprises a controller which, in the image forming operation right after the image forming mode is switched, sets a charge output value of the main charger higher than a specified value while the bipolar photosensitive member rotates by a specified amount. After the bipolar photosensitive member rotates by the specified amount, the image forming operation is carried out with the charge output value of the main charger at the specified value so as to continue the image forming operation.

In the charging time right after the image forming mode is switched, since the charge characteristic is lowered, the lowering of the charging voltage of the photosensitive member is compensated by setting the output value of the main charger higher than the specified value in order to obtain a charge voltage equivalent to a voltage which is obtained when the main charger is set at the specified value. Thus, the image forming operation can be carried out immediately by eliminating the conventional pre-charging process.

BRIEF DESCRIPTION OF THE DRAWING

These and other objects and features of the present invention will become apparent from the following description with reference to the accompanying drawings, in which.

DETAILED DESCRIPTION OF THE PREFERRED EMBODIMENTS

The description of preferred embodiments according to the present invention is given below, referring to the accompanying drawings.

In an embodiment described below, the present invention is applied to a microfilm reader printer.

(Schematic Structure of Reader Printer)

Figure 1:
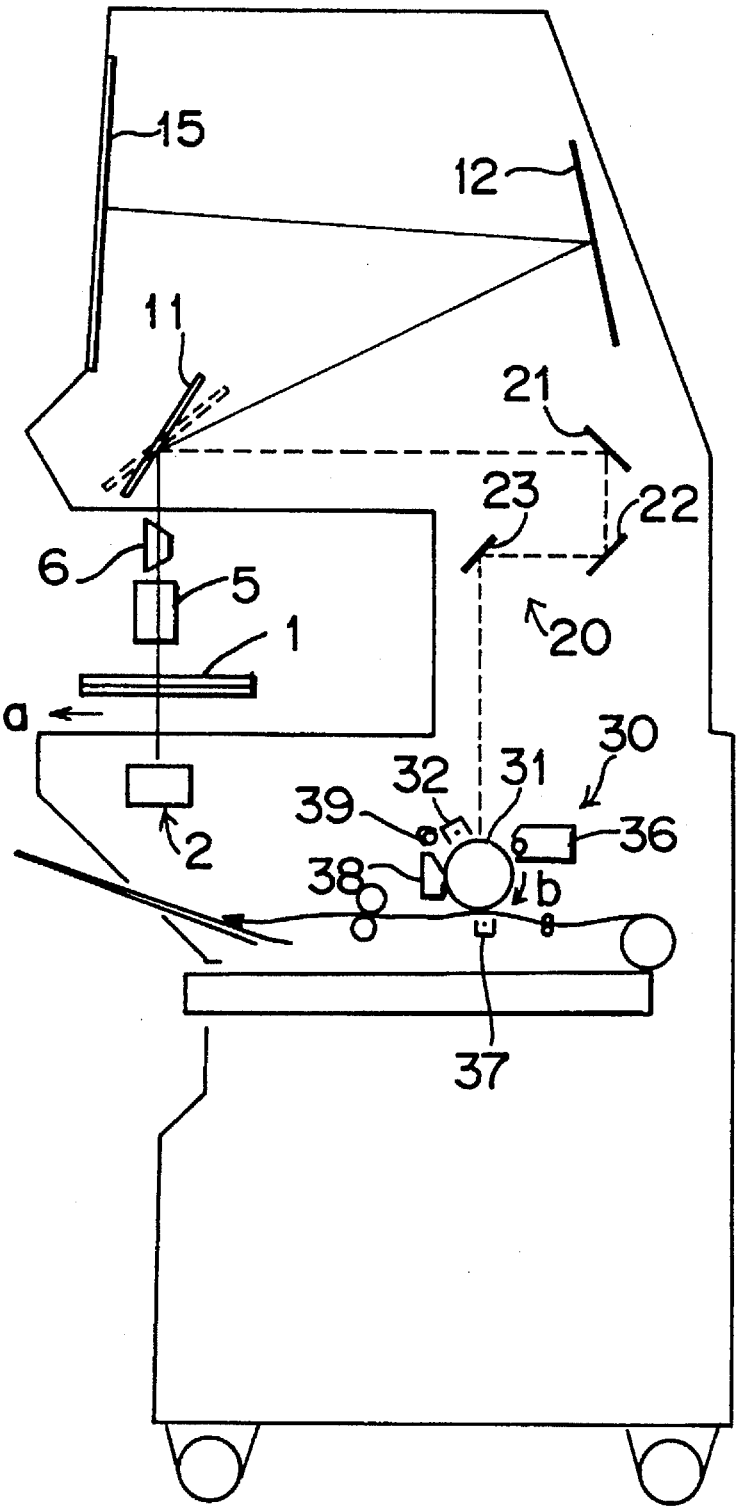
FIG. 1 is a schematic elevational view which shows a reader printer which is an embodiment of the present invention.

In FIG. 1, a reader printer is composed of a microfilm carrier 1, a light source unit 2, mirrors 11 and 12, a screen 15, an exposure optical system 20 for printing and a print unit 30. The light source unit 2 is mainly composed of a lamp and a capacitor lens. A light emitted from the light source 2 goes through a microfilm which is held by the carrier 1, an imaging (magnifying) lens 5 and a prism 6, and is reflected by the mirrors 11 and 12, and then projected on the screen 15.

On the other hand, when an image is printed, the mirror 11 is set at a position indicated with a dotted line, and the carrier 1 is moved in a direction indicated with an arrow a. The light which comes through the microfilm is reflected by the mirror 11 and mirrors 21, 22 and 23 of the exposure optical system 20. Then, a photosensitive drum 31 which rotates in a direction indicated with an arrow b is exposed to the light in a slit shape. Thereby, an electrostatic latent image of the film image is formed on the surface of the photosensitive drum 31.

(Structure of Photosensitive Member)

The photosensitive drum 31 has a laminating type bipolar photosensitive member which is composed of a charge carrier generation layer and a charge carrier transport layer on the surface of a conductive carrier (drum). The conductive carrier is an aluminum cylinder whose outside diameter is 50 mm. The charge carrier generation layer is formed by dispersing trisazo pigment shown by the chemical structure expression (A), butyral resin and cyclohexanone by a sand mill for forty eight hours. The mixing ratio by weight of these materials is trisazo pigment:butyral resin:cyclohexanone=0.45:0.5:50. The dispersed liquid is applied on the periphery surface of the drum such that the thickness of the dried membrane is 0.5 g/m$^2$.

The charge carrier transport layer is formed by liquefying diamino compound shown by the chemical structure expression (B), polycarbonate resin, thiapyrylium salt (type p) shown by the chemical structure expression (C) and dibutyl hydroxy toluene in dlchloromethane. The mixing ratio by weight of these materials is diamino compound:polycarbonate:thiapyrylium salt:dibutyl hydroxy toluene:dichloromethane =50:50:2.5:6:400. The solution is stirred hard for one hour and applied on the charge carrier generation layer such that the thickness of the dried membrane is 20 μm.

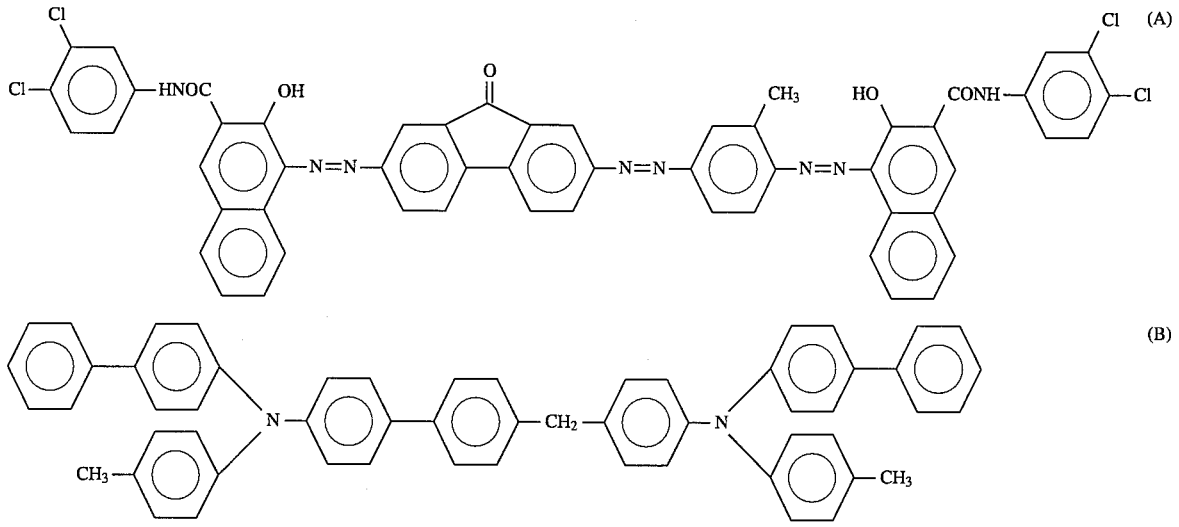

-continued (C)

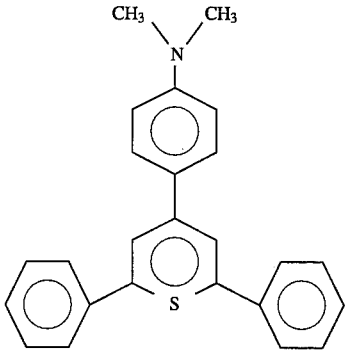

The photosensitive member which has the above structure can be charged to be either positive or negative. In the present embodiment, in order to print a negative film image, the photosensitive member is charged to be positive, and the reverse development is carried out to develop a negative electrostatic latent image using positive toner. In order to print a positive film image, the photosensitive member is charged to be negative, and the normal development is carried out to develop a positive electrostatic latent image using the positive toner.

(Developing Mode Setting)

Whether a film image is negative or positive is judged, when a print key (not shown) is turned on, by scanning the carrier 1 (film) one time preparatively and reading an image optically. Then, the operation is set automatically in the normal development mode or the reverse development mode. Also, these modes can be set by an operator manually. It is also possible to set a program including the frame number of the film to be printed and the number of copies.

(Structure and Operation of Print Unit)

Figure 2:
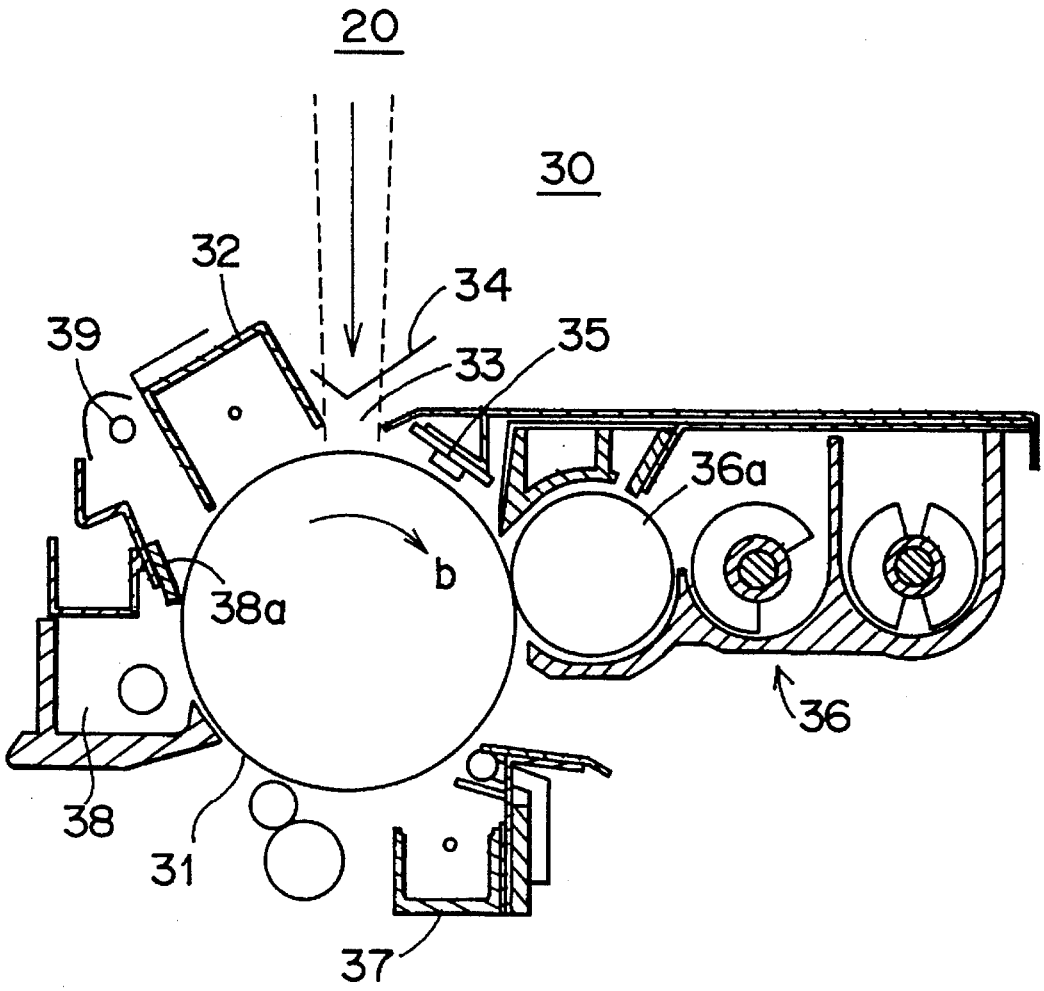
FIG. 2 is a sectional view which shows a print unit contained in the reader printer.

The print unit 30 forms an image in a well-known electrophotogaraphic method. As shown in FIG. 2, the photosensitive drum 31 is provided rotatable in a direction indicated with an arrow b. A charger 32, a slit 33 for exposure, a shutter 34, a sub-eraser 35, a developing device 36, a transfer charger 37, a residual toner cleaner 38 and a main eraser 39 are provided around the photosensitive drum 31.

Figure 3:
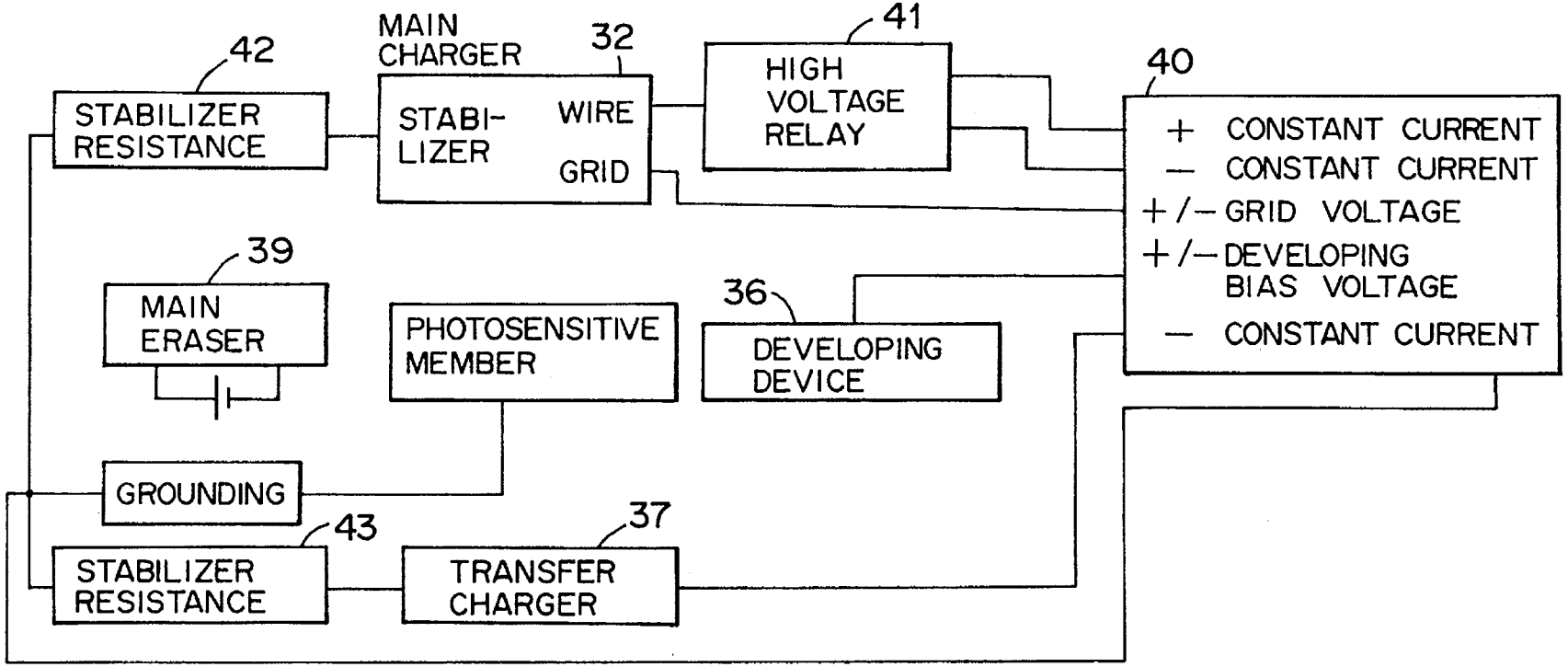
FIG. 3 is a block diagram which shows a control circuit of the print unit.

The charger 32 is a scotorton charger which has a wire for discharge, a mesh grid for controlling charge voltage and a stabilizer. The surface of the photosensitive drum 31 is charged to have a voltage Vo by corona discharge from the wire. As shown in FIG. 3, the wire is connected with an electric source 40 through a high voltage relay 41. In the reverse development mode, a current of +300 μA is supplied to the wire. The voltage applied to the wire at that time is approximately +7 kV. In the normal development mode, a current of −300 μA is supplied to the wire. The voltage applied to the wire at that time is approximately −6 kV. The current supplied from the electric source 40 can be controlled to be set at more than two values both in the positive/negative polarities, and the output value of the current can be switched when necessary.

The stabilizer is grounded through a resistance 42 and helps to improve the charging efficiency of the charger 32. The resistance 42 is 5MΩ. The voltage applied to the stabilizer during discharge is approximately 1 kV. Also, the value of the resistance 42 is changeable, and is switched when necessary.

The grid is connected with the electric source 40. In the reverse development mode, a voltage of +740 V is applied to the grid, and the charge voltage of the photosensitive member at that time is +690 V. In the normal development mode, a voltage of −620 V is applied to the grid, and the charge voltage of the photosensitive member at that time is −600 V. The voltage applied from the electric source 40 can be controlled to be set at more than two values both in the positive/negative polarities.

The slit 33 leads a film light image which is emitted from the exposure optical system 20 onto the photosensitive drum 31. The shutter 34 can close the slit 33 entirely and prevents unnecessary toner consumption during operation in the reverse development mode by preventing the non-image forming area of the photosensitive drum 31 from being exposed. On the other hand, in the normal development mode, the shutter 34 is opened during the printing operation and closed when the printing operation is finished.

The sub-eraser 35 is composed of a plurality of LEDs which are arranged in the axial direction of the photosensitive drum 31. In the normal development mode, the sub-eraser 35 prevents the unnecessary toner consumption by irradiating the non-image forming area of the photosensitive drum 31 to erase the charge of the non-image forming area. Also, the sub-eraser 35 is partially lighted to irradiate the image forming area of the photosensitive drum 31 for masking or side erasing.

The developing device 36 moves a developer which is composed of carrier and toner around a developing sleeve **36*a* and carries out development in a well-known magnetic blush method. By the frictional charge, the carrier is charged to be negative, and the toner is charged to be positive. This positive toner, in the reverse development mode, is deposited on the negative image portion (lower charge portion) of the photosensitive drum 31 which is charged to be positive, and, in the normal development mode, is deposited on the positive image portion (higher charge portion) of the photosensitive drum 31** which is charged to be negative.

The developing sleeve **36*a* is connected with the electric source 40. In the reverse development mode, a voltage of +540 V is applied to the developing sleeve 36*a* as the developing bias voltage. In the normal development mode, a voltage of −150 V is applied. In the reverse development mode, in order to prevent the carrier deposition on the non-image forming area, the developing bias voltage is applied only while the image forming area is passing by the developing device 36** including right before and right after the image forming area. In the normal development mode, in order to prevent the toner deposition on the non-image forming area, the developing bias voltage is continuously applied during the printing operation.

The charger 37 charges a sheet to be negative by corona discharge in the corotron method, and thereby, the positive toner is transferred onto the sheet. The wire is connected with the electric source 40. A current of −110 μA is supplied to the wire in the reverse development mode, and a current of −190 μA is supplied to the wire in the normal development mode. The reason why the current value is changed between the normal development mode and the reverse development mode is that the amount of toner deposition on the photosensitive drum 31 differs between the two development modes. In the reverse development mode, since the amount of toner deposition on the photosensitive drum 31 is small and a noise may be memorized on the photosensitive member by the influence of the transfer electric field, the current value is set low. The switch of the current value is carried out in the electric source 40 or by changing the resistance value of the grounding resistance 43 which is connected with the stabilizer. Also, the current is supplied to the transfer charger 37 when the sheet is passing between the photosensitive drum 31 and the transfer charger 37 in order not to apply the transfer charge on the photosensitive member directly.

The cleaner 38 presses a blade 38a which is made from elastic material onto the photosensitive drum 31 in the forward direction to scratch off the residual toner after the transfer from the surface of the photosensitive drum 31.

The main eraser 39 is a stick-shaped lamp and provided in the axial direction of the photosensitive drum 31. The main eraser 39 erases the charge on the photosensitive drum 31 by irradiating the photosensitive drum 31 with the light after transfer, and stabilizes the charge in the next printing operation. In the present embodiment, since the polarity charged on the photosensitive drum 31 is switched between the normal development mode and the reverse development mode, considering the electrophotographic characteristic of the photosensitive member, the timing of the irradiation is changed. In the normal development mode, the main eraser 39 is controlled such that the irradiating time becomes the shortest. In the reverse development mode, the main eraser 39 is controlled to irradiate the photosensitive drum 31 in synchronization with the rotation of the photosensitive drum 31, and keep irradiating during the rotation. This point is described in detail below.

(First Control Method, Pre-charging and Erase Timing)

Figure 4:
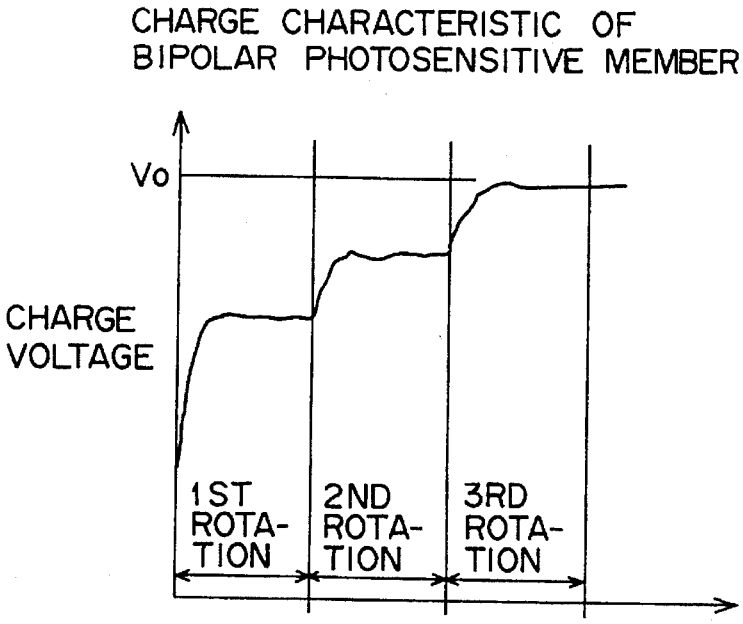
FIG. 4 is a graph which shows a charge characteristic right after a polarity of a bipolar photosensitive member is switched.

As for the photosensitive drum 31 with an outside diameter of 50 mm used in this embodiment, when the size of a copy is A4 vertical (the longer side of the sheet is parallel to the circumferential direction of the photosensitive drum 31), an area which is equivalent to two rotations of the photosensitive drum 31 is required as the image forming area. Thus, usually, the area which is equivalent to two rotations of the photosensitive drum 31 is also required as the charge area. In this bipolar photosensitive member, the charge voltage rises slowly right after the charge polarity is switched (refer to FIG. 4). More specifically, after charging and charge erasing are repeated twice, when the third charging is carried out, the bipolar photosensitive member obtains the specified charge voltage Vo for the first time. Therefore, right after the charge polarity is switched, the pre-charging and the charge erasing are carried out during the first and second rotations, and the printing operation needs to be carried out during the third and fourth rotations.

Figure 5:
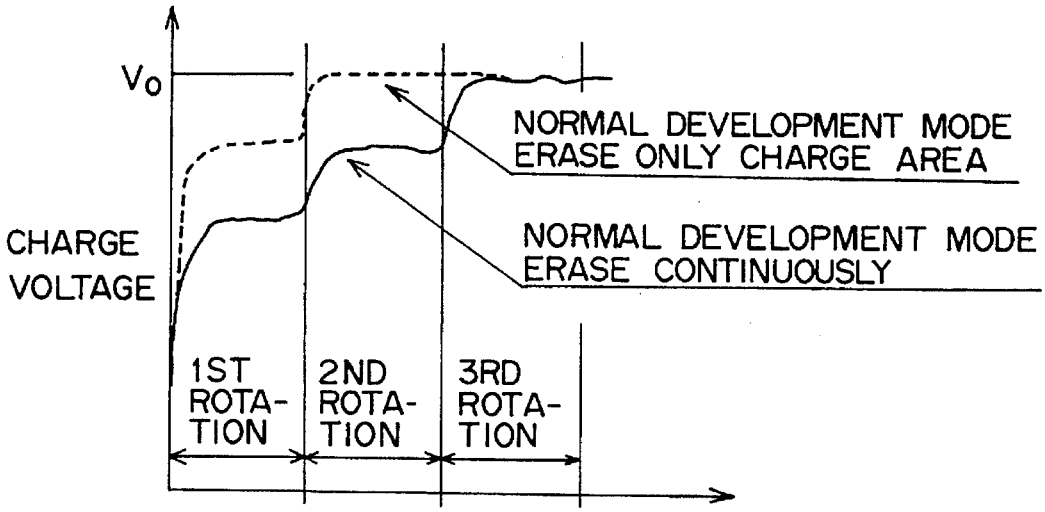
FIG. 5 is a graph which shows the charge characteristic of the bipolar photosensitive member right after a normal development mode is switched to a reverse development mode.

The characteristic which is indicated with a solid line in a graph of FIG. 5 is, when the main eraser 39 is kept on while the photosensitive drum 31 is rotated in the normal development mode, a charge characteristic of the photosensitive member (positive polarity charge) right after the operation is switched to the reverse development mode. On the other hand, at least in the last printing operation in the normal development mode, if the main eraser 39 is turned on to irradiate only the charge area of the photosensitive drum 31, the charge characteristic of the photosensitive member (positive polarity charge) right after the operation is switched to the reverse development mode is improved as indicated with a dotted line in FIG. 5.

Figure 6:
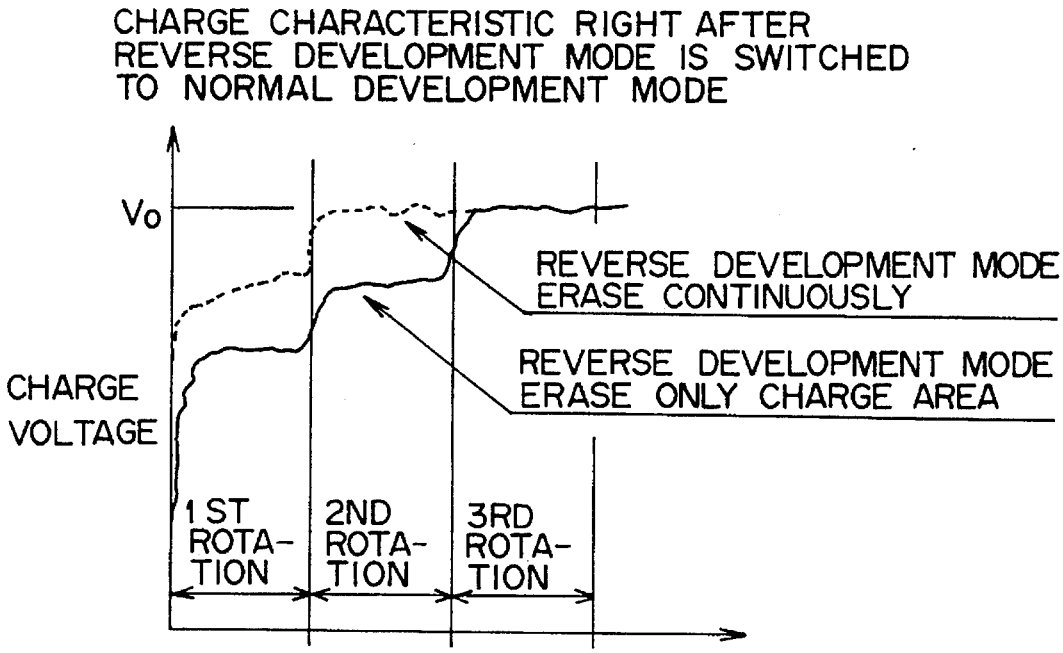
FIG. 6 is a graph which shows the charge characteristic of the bipolar photosensitive member right after the reverse development mode is switched to the normal development mode.

Also, a characteristic indicated with a solid line in a graph of FIG. 6 is, when the main eraser 39 is turned on to irradiate only the charge area of the photosensitive drum 31, a charge characteristic of the photosensitive member (negative polarity charge) right after the operation is switched to the normal development mode. On the other hand, at least in the last copying operation in the reverse development mode, if the main eraser 39 is turned on to irradiate the charge area but also the non-charge area of the photosensitive drum 31, a charge characteristic of the photosensitive member (negative polarity charge) right after the operation is switched to the normal development mode is improved as indicated with a dotted line in FIG. 6.

Thus, by controlling the irradiating timing of the main eraser 39 as described above, right after the charge polarity is switched, the specified charge voltage Vo can be obtained at the second rotation of the photosensitive drum 31. Thus, the pre-charging process can be finished during one rotation of the photosensitive drum 31.

Figure 7:
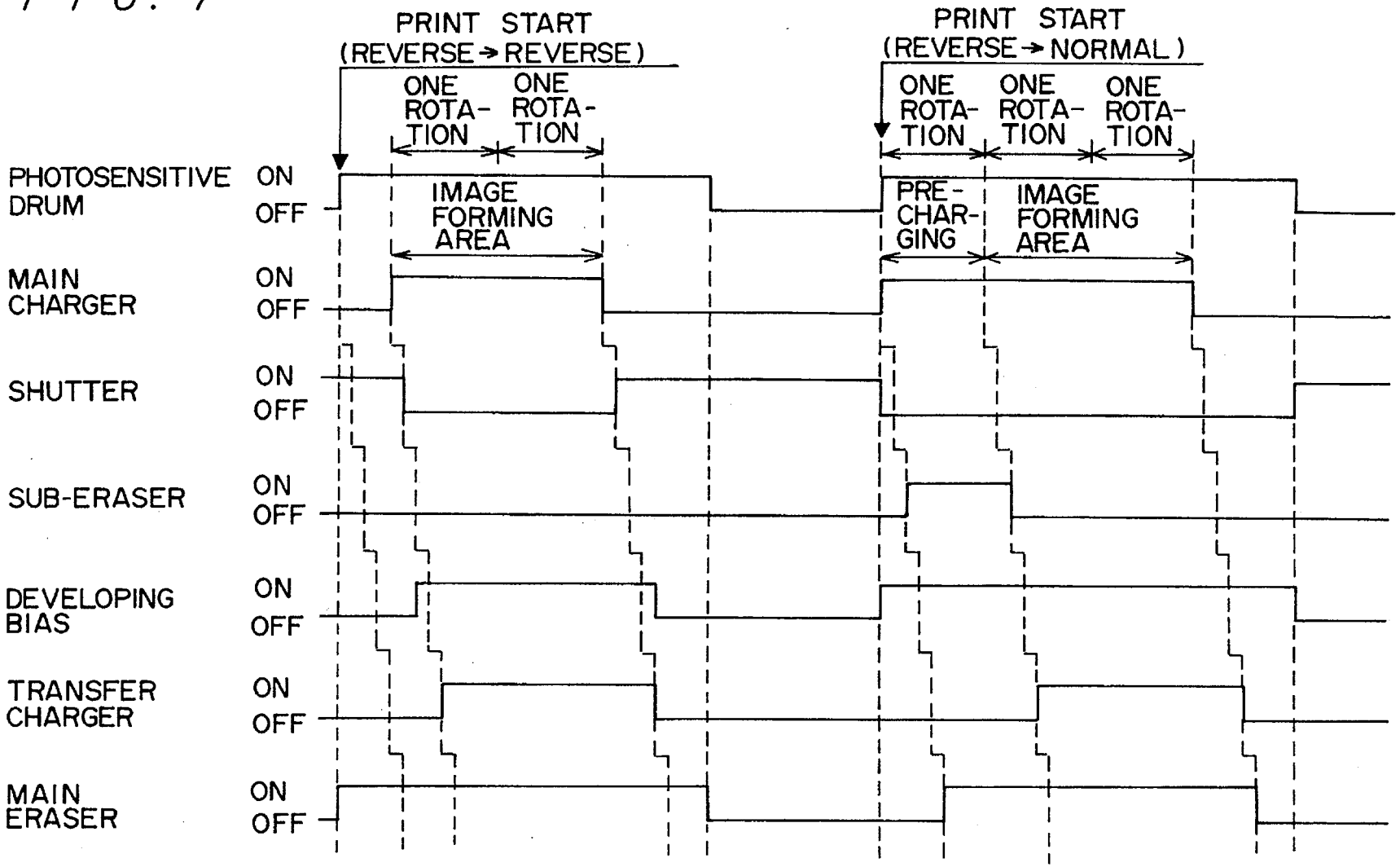
FIG. 7 is a time chart which shows a first control sequence in the present embodiment in a case when the reverse development mode is carried out after the reverse development mode and then is switched to the normal development mode.
Figure 8:
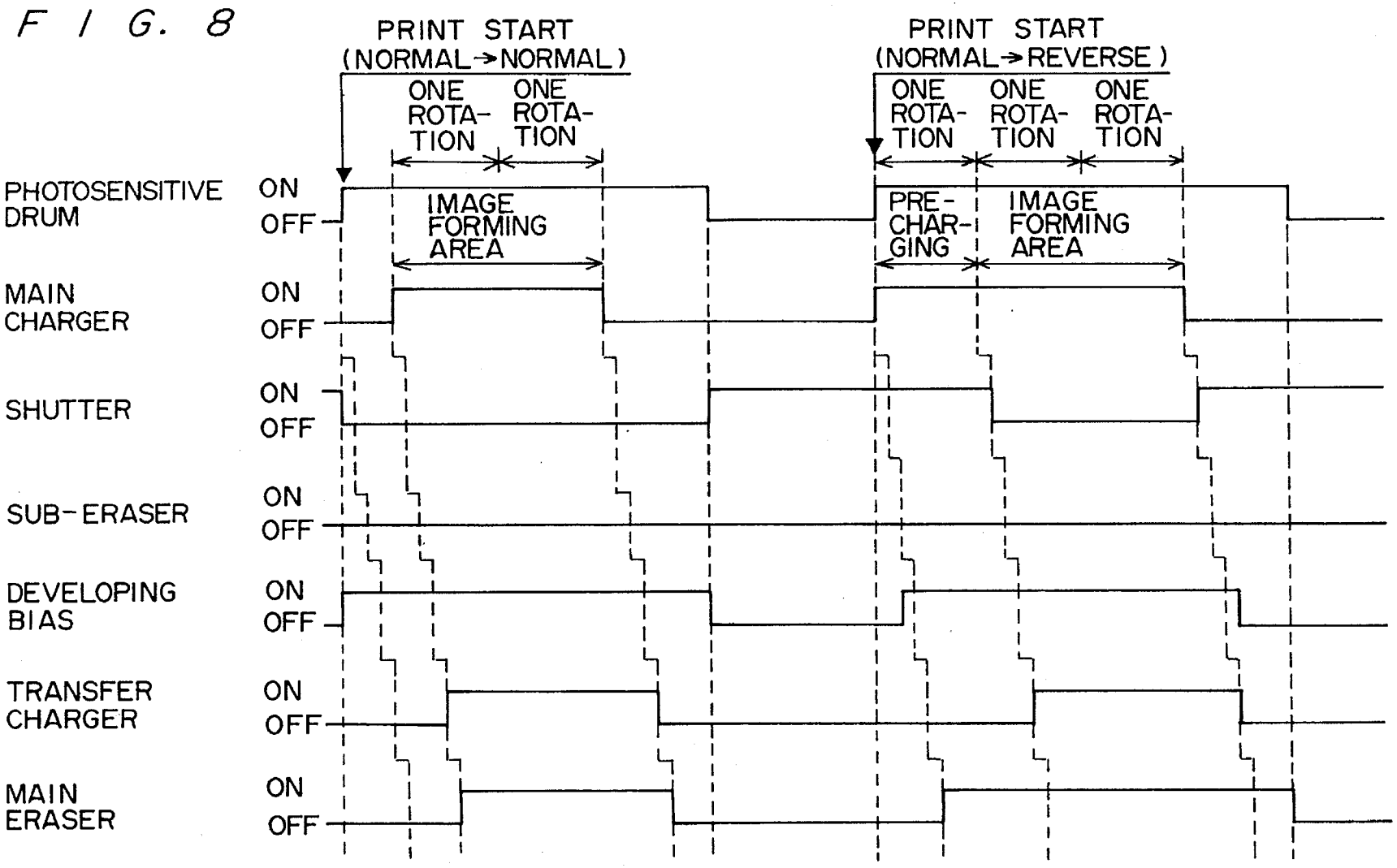
FIG. 8 is a time chart which shows the first control sequence in the present embodiment in a case when the normal development mode is carried out after the normal development mode and then is switched to the reverse development mode.

FIGS. 7 and 8 show the above control sequence.

FIG. 7 shows a case that a printing operation is carried out in the reverse development mode after an operation in the same mode, and the next printing operation is carried out in the normal development mode. In the reverse development mode when the polarity of the previous charging is the same, the printing operation is carried out without the pre-charging operation. In this printing operation, the main eraser 39 is turned on in synchronization with the rotation of the photosensitive drum 31 and irradiates the charge area and the non-charge area.

When the printing operation is carried out in the normal mode after the above operation, the pre-charging by the charger 32 and the erasing operation by the main eraser 39 are carried out during the first rotation of the photosensitive drum 31, and the printing operation is started at the second rotation.

FIG. 8 shows a case that the printing operation is carried out in the normal development mode after the operation in the same mode, and next printing operation is carried out in the reverse development mode. In the normal development mode wherein the charge of the previous operation was the same polarity, the printing operation is started without the pre-charging, and the main eraser 39 is turned on to irradiate only the charge area of the photosensitive member.

Next, when the printing operation is carried out in the reverse development mode, the pre-charging by the charger 32 and the erasing by the main eraser 39 are carried out during the first rotation of the photosensitive drum 31, and the printing operation is started at the second rotation.

In the above-described first control method, right after the charge polarity is switched, the pre-charging operation, which is carried out during two rotations of the photosensitive drum in the conventional method, is finished during only one rotation of the photosensitive drum, and the operation can go to the printing quickly.

(Second Control Method, Switching Output Value of Charger)

In the second control method, right after the charge polarity is switched, the output of the charger 32 is set large at the first rotation of the photosensitive drum 31 to compensate the lowering of the charge potential caused by the previous polarity, without the pre-charging. In order to set the output of the charger 32 higher, the applied voltage to the wire, the applied voltage to the grid or the resistance value of the resistance 42 is switched high.

Figure 9:
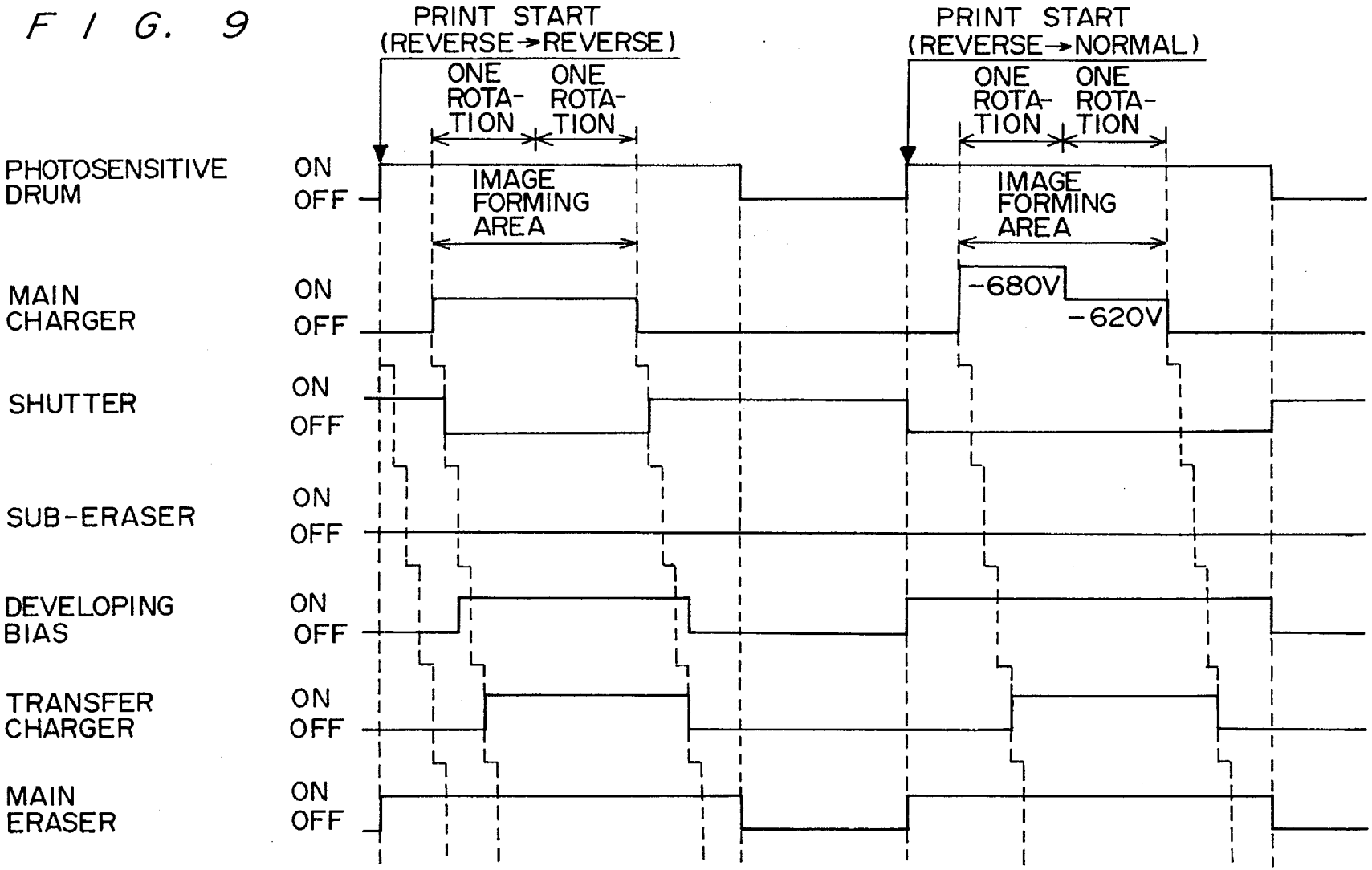
FIG. 9 is a time chart which shows a second control sequence in the present embodiment in a case when the reverse development mode is carried out after the reverse development mode and then is switched to the normal development mode.
Figure 10:
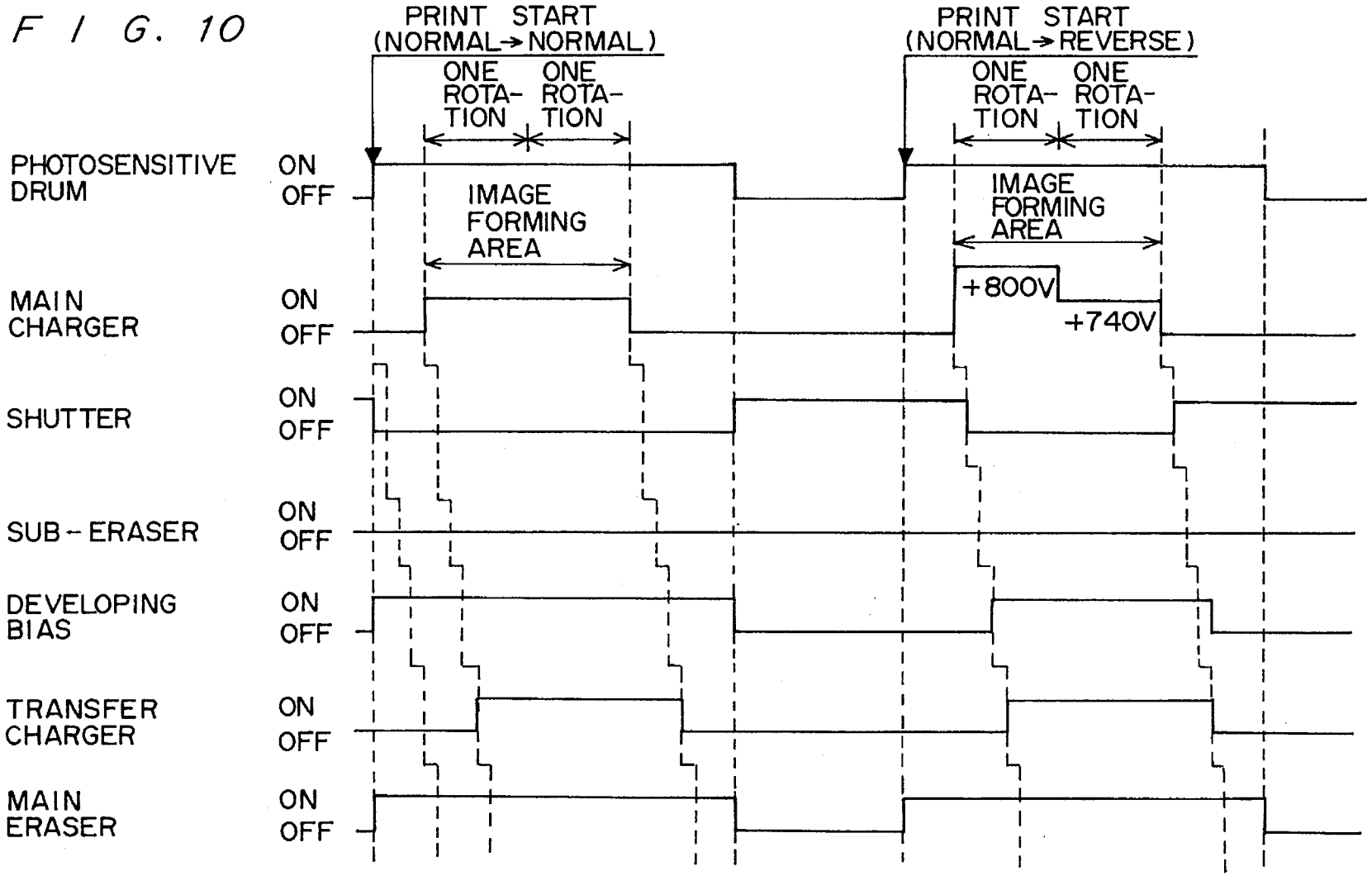
FIG. 10 is a time chart which shows the second control sequence in the present embodiment in a case when the normal development mode is carried out after the normal development mode and then is switched to the reverse development mode.

More specifically, as shown in FIG. 9, right after the operation is switched from the reverse development mode to the normal development mode, the grid voltage is set at −680 V at the first rotation of the photosensitive drum 31, and the charge voltage Vo is obtained, and the printing operation is carried out. At the second rotation, since the influence of the previous polarity is already erased, the grid voltage is switched to −620 V which is the normal voltage and the printing operation is continued. On the other hand, as shown in FIG. 10, right after the operation is switched from the normal development mode to the reverse development mode, the grid voltage is set at +800 V at the first rotation of the photosensitive drum 31, and the charge voltage Vo is obtained, and the printing operation is carried out. At the second rotation, since the influence of the previous polarity is already erased, the grid voltage is set at +740 which is the normal voltage and the printing operation is carried out.

In the second control method, right after the charge polarity is switched, the pre-charging which is operated during two rotations of the photosensitive drum in the conventional method can be omitted, and the printing operation can be started immediately.

In the present invention, as for the relationship between the charge polarity of the bipolar photosensitive member, the charge polarity of the toner and the development mode, an image can also be formed by the toner which has negative polarity using the bipolar photosensitive member in the above embodiment. In this case, in the reverse development mode, a negative image is formed on the photosensitive member which is charged to be negative, and the negative toner is deposited on the image portion (lower potential portion). In the normal development mode, a positive image is formed on the photosensitive drum which is charged to be positive, and the negative toner is deposited on the image portion (higher potential portion). In this case, in the reverse development mode at least right before the operation is switched to the normal development mode, only the charge area is irradiated by the main eraser. In the normal development mode at least right before the operation is switched to the reverse development mode, not only the charge area but also the non-charge area are irradiated by the main eraser.

Although the present invention has been described in connection with the preferred embodiments above, it is to be noted that various changes and modifications are apparent to a person skilled in the art. Such changes and modifications are to be understood as being within the scope of the present invention.

What is claimed is:

1. An image forming apparatus comprising:

a bipolar photosensitive member which can be charged to have a first polarity or a second polarity;

a main charger for charging the bipolar photosensitive member to a charge of the first polarity or the second polarity;

an exposure optical system for exposing the bipolar photosensitive member, which is charged by the main charger, to a light and forming an electrostatic latent image thereon;

a developing device for carrying out a normal development or a reverse development to develop the electrostatic latent image formed on the bipolar photosensitive member with toner;

a transfer charger for transferring a developed toner image onto a sheet;

an eraser for erasing the charge by irradiating the bipolar photosensitive member after the transfer; and a controller for controlling the eraser in first and second control modes, in the first control mode the eraser irradiates not only a charged area on the bipolar photosensitive member but also a noncharged area on the bipolar photosensitive member during an image forming operation wherein the bipolar photosensitive member is charged to the first polarity at least right before the apparatus is switched to an image forming operation wherein the bipolar photosensitive member is charged to the second polarity, and in the second control mode the eraser irradiates only a charged area on the bipolar photosensitive member during an image forming operation wherein the bipolar photosensitive member is charged to the second polarity at least right before the apparatus is switched to an image forming operation wherein the bipolar photosensitive member is charged to the first polarity.

2. An image forming apparatus comprising:

a bipolar photosensitive member which can be charged to have a first or a second polarity;

a main charger for charging the bipolar photosensitive member to have the first or the second polarity;

an exposure optical system for exposing the bipolar photosensitive member which is charged by the main charger to a light and forming an electrostatic latent image thereon;

a developing device for carrying out a normal development or a reverse development to develop the electrostatic latent image formed on the bipolar photosensitive member with toner;

a transfer charger for transferring a developed toner image onto a sheet;

an eraser for erasing charge by irradiating the bipolar photosensitive member after the transfer;

a switching device for switching an image forming mode which is carried out with the bipolar photosensitive member charged to have the first polarity and an image forming mode which is carried out with the bipolar photosensitive member charged to have the second polarity; and a controller for controlling the main charger, the controller, in an image forming operation right after the image forming mode is switched, setting a charge output value of the main charger higher than a specified value while the bipolar photosensitive member rotates by a specified amount and thereafter setting the charge output value of the main charger at the specified value so as to continue the image forming operation.

* * * * *